US010973323B2

(12) United States Patent
Prentner et al.

(10) Patent No.: US 10,973,323 B2
(45) **Date of Patent: *Apr. 13, 2021**

(54) HOLDING DEVICE FOR A FRONT PANEL OF A DRAWER

(71) Applicant: Samet Kalip Ve Maden Esya San. Ve Tic. A.S., Istanbul (TR)

(72) Inventors: Christian Prentner, Altach (AT); Nurettin Güzeltepe, Büyükçekmece/Istanbul (TR)

(73) Assignee: Samet Kalip Ve Maden Esya San. Ve Tic. A.S., Istanbul (TR)

( * ) Notice: Subject to any disclaimer, the term of this patent is extended or adjusted under 35 U.S.C. 154(b) by 7 days.

This patent is subject to a terminal disclaimer.

(21) Appl. No.: 16/604,065

(22) PCT Filed: May 8, 2018

(86) PCT No.: PCT/TR2018/050214

§ 371 (c)(1),
(2) Date: Oct. 9, 2019

(87) PCT Pub. No.: WO2018/236324

PCT Pub. Date: Dec. 27, 2018

(65) Prior Publication Data

US 2020/0054131 A1 Feb. 20, 2020

(30) Foreign Application Priority Data

May 9, 2017 (WO) ..... PCT/TR2017/000049

(51) Int. Cl.
*A47B 88/00* (2017.01)
*A47B 88/95* (2017.01)

(52) U.S. Cl.
CPC ..... *A47B 88/95* (2017.01); *A47B 2088/954* (2017.01)

(58) Field of Classification Search
CPC ..... A47B 88/95; A47B 88/941; A47B 88/956; A47B 2088/954
See application file for complete search history.

(56) References Cited

U.S. PATENT DOCUMENTS 4,846,538 A * 7/1989 Rock ..... A47B 88/956 312/263
5,540,515 A 7/1996 Roeck et al.
(Continued)

FOREIGN PATENT DOCUMENTS

DE 202015102087 U1 9/2015
DE 102014011090 A1 2/2016
(Continued)

OTHER PUBLICATIONS

International Search Report from corresponding PCT/TR2018/050214, dated Jan. 11, 2019, 11 pages (not prior art).
(Continued)

*Primary Examiner* — Matthew W Ing
(74) *Attorney, Agent, or Firm* — Lucian Wayne Beavers; Patterson Intellectual Property Law, PC

(57) ABSTRACT

A securing device (1) for securing a front panel of a drawer to a drawer frame, having a holding element (2) for securing to the front panel and a closing element (3) for securing to the drawer frame. A spring (44) is operatively connected to the closure (50). The closure (50) is implemented for exposing a holding region of the holding element (2) in an open rotational position of the closure (50), and for blocking the holding region in a closed position of the closure (50). A transmission element (60) is hinged to the closure by a rotating/sliding connection on the closure side spaced apart from the rotary axis of the closure. A rotating/sliding connection on the opener side having a first bearing element (64) is disposed on the transmission element (60) opposite the rotating/sliding connection on the closure side. The
(Continued)

Figure 1:
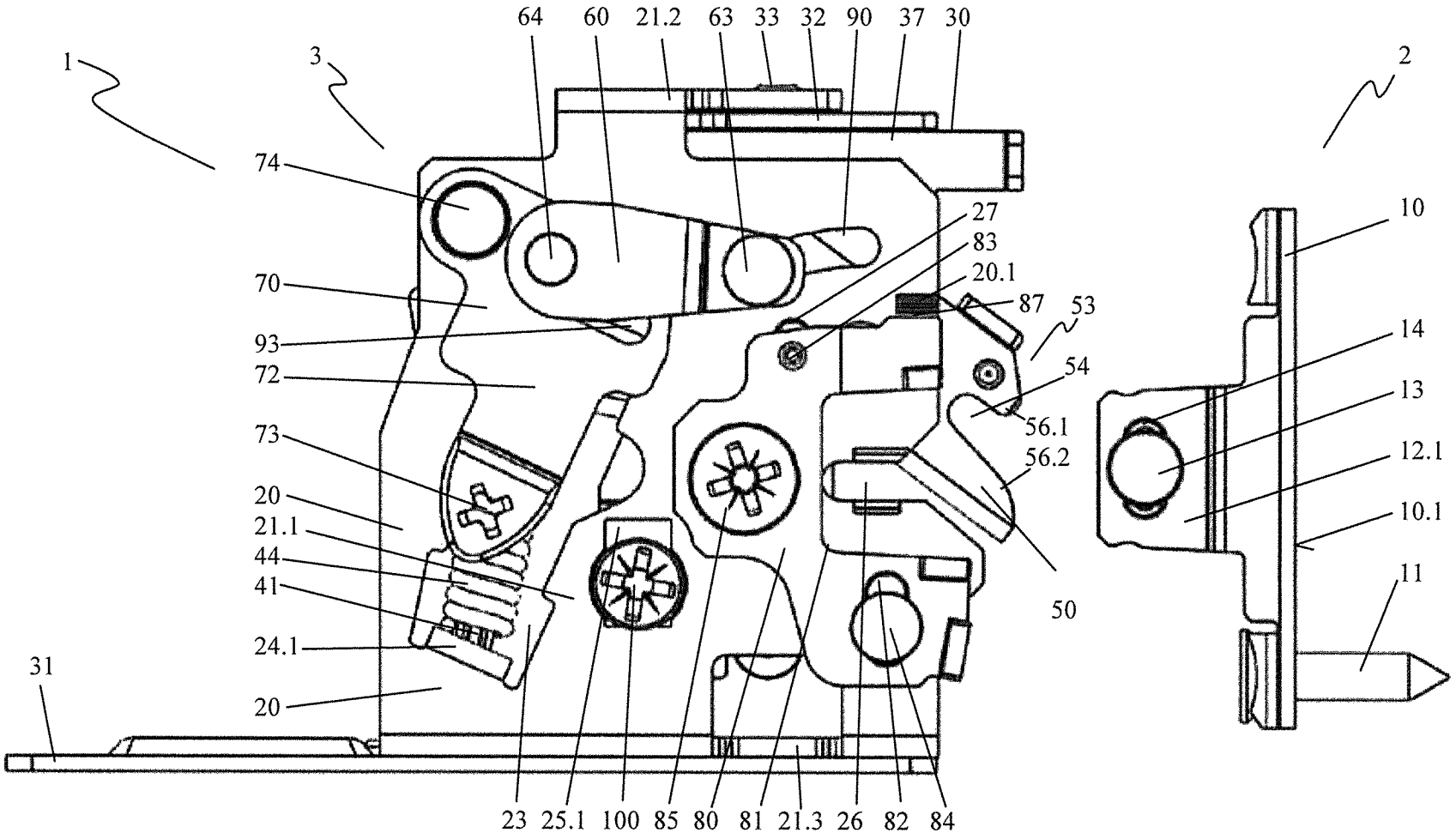

rotating/sliding connection on the opener side produces a connection to a displaceably supported opener (70). The rotating/sliding connection on the opener side comprises a first and a second control curve (92, 93) in which the first bearing element (64) is guided, and the two control curves (92, 93) intersect. The transmission element (60) is preferably implemented having a plurality of parts and comprises a plurality of lever arms (60.1, 60.2). The transmission element (60) is particularly preferably implemented as a toggle lever.

17 Claims, 11 Drawing Sheets

(56) References Cited

U.S. PATENT DOCUMENTS

| | | | | |
|---|---|---|---|---|
| 9,033,436 | B2 * | 5/2015 | Holzapfel | A47B 88/956 312/348.4 |
| 10,010,174 | B2 * | 7/2018 | Chen | A47B 88/95 |
| 10,188,209 | B2 * | 1/2019 | Hoffmann | A47B 88/95 |
| 10,799,024 | B2 * | 10/2020 | Bektas | A47B 88/941 |
| 2010/0102692 | A1 * | 4/2010 | Hammerle | A47B 88/956 312/348.4 |
| 2014/0072366 | A1 | 3/2014 | Holzapfel et al. | |
| 2014/0252936 | A1 * | 9/2014 | Holzapfel | A47B 88/956 312/348.4 |
| 2017/0265645 | A1 * | 9/2017 | Kruger | A47B 88/956 |

FOREIGN PATENT DOCUMENTS

| | | | |
|---|---|---|---|
| DE | 102016105969 | A1 | 10/2016 |
| EP | 740917 | A1 | 11/1996 |
| GB | 2532100 | A | 5/2016 |
| WO | 2012171047 | A1 | 12/2012 |

OTHER PUBLICATIONS

Co-pending U.S. Appl. No. 16/604,064, filed Oct. 9, 2019 (not prior art).

* cited by examiner

HOLDING DEVICE FOR A FRONT PANEL OF A DRAWER

The invention relates to a securing device for securing a front panel of a drawer to a drawer frame, having a holding element for securing to the front panel and a closing element for securing to the drawer frame, the closing element comprising a support and a closure having a holding segment supported rotatably about an axis of rotation on the support, a spring having an operative connection to the closure, and the closure being implemented for releasing a holding region of the holding element in an open rotational position of the closure, and for blocking the holding region in a closed position of the closure.

One such holding device is known from EP 0 740 917 A1. A holding part is thereby disposed on a front panel and a supporting part is disposed on a drawer frame of a drawer. A locking part implemented as a rotatably supported, spring-loaded rocker lever is associated with the supporting part. The holding part can be inserted into the supporting part for securing the front panel on the drawer frame, wherein the rocker lever latches to the holding part due to the spring action. A receptacle for a screwdriver or the like is associated with the rocker lever, by means of which said lever can be rotated opposite the spring action out of the closed position, thereby releasing the holding part.

Accordingly, in the embodiment examples shown in EP 0 740 917 A1, the rocker lever can comprise a notch on the outer edge thereof. Said notch faces the front panel in a first rotational orientation of the rocker lever, so that when inserted, a segment of the holding part engages in the notch and thereby rotates the rocker lever opposite the acting spring force. A spring is directly connected to the rocker lever. When inserting the holding part and thereby rotating the rocker lever, the bearing of the spring on the rocker lever passes a dead center point and then acts in the closing direction of the rocker lever. The holding part is thereby drawn into the supporting part. In order to avoid unintentional opening of the rocker lever by pulling on the front panel, said lever is blocked in the circumferential direction by an additional blocking element engaging in the rocker lever in the closed position thereof. A screwdriver is inserted into the receptacle provided and the rocker lever is rotated up opposite the spring force for opening the connection between the holding part and the supporting part. The screwdriver thereby simultaneously displaces the blocking element so that the rocker lever is released. When the holding part is pulled out of the supporting part, the support of the spring again passes the dead center point, so that the fully opened rocker lever remains in the open position thereof.

A disadvantage of the present arrangement is that the spring must be aligned with and connected to the rocker lever such that the extended center axis of said spring intersects the center of rotation of the rocker lever when the rocker lever rotates, in order to thus implement a dead center point. The result is an elongated structure occupying a large space and correspondingly requiring large installation areas on the drawer. A further disadvantage arises from the fact that the arrangement cannot be self-blocking. Additional blocking elements for fixing the rocker lever must therefore be provided and must be opened simultaneously with the closure when the screwdriver engages in the associated tool receptacle of the rocker lever for opening the closure. The screwdriver must therefore be implemented both for engaging in the tool receptacle and for actuating the blocking element.

According to a further, self-blocking embodiment variant disclosed in EP 0 740 917 A1, the rocker lever is displaced about the axis of rotation thereof into the displacement path of the holding part by means of a yoke spring. The front edge of said lever thereby contacts a support surface of the holding part facing toward the front panel in the closed position thereof. A disadvantage of said arrangement is that the holding part is not drawn from the rocker lever into the supporting part due to the spring force. The front panel having the holding part must therefore be precisely aligned relative to the drawer frame having the supporting part in order to allow the front panel to be installed without clearance. Even slight positioning errors of the holding part and the supporting part lead to the front panel not making firm contact with the drawer frame, or the holding part not being able to be sufficiently inserted into the supporting part in order to displace the rocker lever into the closed position thereof and to block the holding part.

The object of the invention is therefore to provide a holding device for a front panel of a drawer allowing precise positioning of the front panel and having a space-saving structure.

The object of the invention is achieved in that a transmission element is hinged to the closure by means of a rotating/sliding connection on the closure side, spaced apart from the axis of rotation of the closure, that a rotating/sliding connection on the opener side having a first bearing element is disposed on the transmission element opposite the rotating/sliding connection on the closure side, that the rotating/sliding connection on the opener side produces a connection to a displaceably supported opener, that the rotating/sliding connection on the opener side comprises a first and a second control curve on which the first bearing element is guided, and that the two control curves intersect. The closure can be displaced from the closed position thereof into the open position thereof by means of the opener. The closure and the opener can be implemented as separate components due to the transmission element. The component size and the displacement path of both the closure and the opener can thereby be optimized such that each occupies only a small space. The intersecting control curves allow optimizing the force transmission between the opener and the transmission element. Said curves further allow sufficiently large adjustment of the closure with short displacement paths of the opener and the transmission element.

It can preferably be provided that the first control curve is disposed on the carrier and/or that the second control curve is disposed on the opener. The first control curve disposed on the support can define the motion of the transmission element when opening or closing the closure. The second control curve on the opener makes it possible that the transmission element can follow the first guide curve and simultaneously be coupled to the opener.

The force transmission between the opener and the transmission element and the space-saving motion path of the transmission element and/or of the opener can thereby be further improved or minimized in that at least one of the control curves runs on a curved path.

To allow force transmission between the opener and the transmission element and the guided motion of the transmission element, it can be provided that the first bearing element is connected to the transmission element.

According to a particularly preferred embodiment variant of the invention, it can be provided that the spring acts on the first bearing element transverse to the alignment of the first control curve and that the spring pushes or pulls the first bearing element into a first end position when the closure is closed and into an opposite second end position of the first control curve when the closure is opened. The first control curve thus defines two stable positions, between which the first bearing element and thus the transmission element can be displaced. One end position is thereby associated with the open closure and the other end position is associated with the closed closure.

The first control curve is preferably curved opposite the acting spring force. The curvature of the first control curve causes the first bearing element to be pressed into one or the other end position by the acting spring force and held there. The spring force is thus deflected by the first control curve in or opposite to the direction of motion of the transmission element. When closing the closure, a force is transmitted by the holding element from the closure to the transmission element. Said force causes the first bearing element to be displaced along the first control curve from the second end position into the first end position. The spring force thereby initially acts opposite the closing motion, until the first bearing element passes a vertex point of the first control curve. The spring then acts in the direction of displacing of the first bearing element into the first end position. The spring force is thus transmitted by means of the transmission element to the closure and said closure closes automatically after a corresponding closing position and thereby draws in the holding element. The front panel is thereby drawn into the desired position thereof relative to the drawer frame. By actuating the opener, the first bearing element can be displaced out of the first end position of the first control curve into the second end position of the first control curve. The closure is thereby opened. When opening, the spring acts in the opening direction of the closure after passing the vertex point of the first control curve, so that said closure opens automatically in the last motion segment thereof.

The closure can be easily displaced from the closed into the open position thereof, in that the first bearing element can be displaced from the first end position of the first control curve into the second end position of the first control curve by a rotary motion of the opener.

It can preferably be provided that the first bearing element is disposed along the second control curve at a greater radius when the closure is closed and at a lesser radius when the closure is open, relative to the center of rotation of the opener. The second control curve intersecting the first control curve allows displacing the first bearing element along the first control curve while simultaneously coupling to the opener due to the radially aligned component thereof.

According to a preferred embodiment variant of the invention, it can be provided that the second control curve is curved in the end region thereof lying at a lesser radius about the center of rotation of the opener, opposite to the direction of rotation of the opener when opening the closure. The curved path of the second control curve achieves a large displacing of the transmission element and thus of the closure for comparatively little rotation of the opener. This leads to a compact structure of the securing device.

It can be particularly preferably provided that the first control curve is aligned transverse to the acting force of the transmission element in the region of the first end position thereof, such that the first bearing element is held in the first end position in a self-blocking manner when the closure is closed. A tensile load, such as is transmitted to the closures when pulling open the drawer by the front panel and the holding element mounted thereon, thus does not lead to opening the closure, due to the self-blocking. The front panel is accordingly securely held on the drawer frame and can only be released by actuating the opener accordingly.

A compact structure of the securing device can be achieved in that the transmission element is hinged to the closure and spaced apart from the axis of rotation of the closure by means of a rotating/sliding connection on the closure side, that the rotating/sliding connection on the closure side comprises a first and a second guide curve, and that both guide curves intersect. By using the transmission element, the spring does not need to be aligned in the direction of the axis of rotation of the closure element. This leads to a very compact structure of the securing device. The intersecting guide curves allow optimal force application by the transmission element to the closure. The space occupied by the transmission element for performing the setting motion thereof is simultaneously minimized in order to allow the required rotary motion of the closure.

According to another advantageous refinement of the invention, it is proposed that the transmission element comprises at least two toggle levers each coupled to each other by means of a coupling joint, wherein the transmission element comprises a second bearing element in the region of the coupling joint and guided in a third guide curve. The transmission element particularly preferably comprises two lever arms coupled to each other as a toggle lever by means of a coupling joint. In the region of the coupling joint, the toggle lever has the second bearing element guided in the third guide curve. In an open position of the closure, the second bearing element is preferably on a side facing away from the spring element of an imaginary line connecting the bearing piece on the closing side and the first bearing element on the opener side. During such a closing motion of the closure from the open position into a closed position, the connecting line and the second bearing element are displaced relative to each other, and near the end of the closing motion, the second bearing element crosses the connecting line and is then on the side of the connecting line facing toward the spring element. From this time forward, the closure is secured by means of self-blocking, wherein said closure need no longer be present in the completely closed position thereof. The spring force of the spring element continuing to act on the first bearing element presses the transmission element and thus the closure further into the closed position.

The third guide curve is preferably implemented in the support. Said curve can be implemented separately from the first control curve and/or the first guide curve. It is particularly preferred, however, if the third guide curve is implemented in the support in a transition from the first control curve into the first guide curve, so that said three curves together form a continuous curve path. This has the advantage that the second bearing element can be guided not only in the third guide curve, but also can enter the first guide curve or first control curve at the start and end of the third guide curve. A particularly compact structure of the support and thus the entire securing device is thereby possible.

According to a preferred embodiment of the invention, one of the lever arms of the transmission element, preferably the lever arm on the closure side guided by means of the bearing piece in the second guide curve at the closure, is implemented as a locking lever securing the closures in the closed position thereof by interacting with the curve path of the third guide curve and/or of the first guide curve. This is done in that the second bearing element crosses the imaginary connecting line between the first bearing element on the opener side and the bearing piece on the closure side during a closing motion of the closure from the open position into the closed position and is then present on the side of the connecting line facing toward the spring element. From this point forward, the closure is secured by means of self-blocking.

Due to the rather complex embodiment of the rotating/sliding connection on the closure side having the bearing piece, the rotating/sliding connection having the first bearing element on the opener side, the multipart transmission element, and the corresponding guide track formed by the first guide curve, the first control curve, and the second guide curve, the closure element can have some clearance under certain circumstances, such as in the closed position thereof. In order to prevent this, it is proposed that a part of the transmission element is implemented and arranged for forcing the closure into the closed position by interacting with an outer contour of the closure at least near the end of a closing motion of the closure from the open position into the closed position. The closure is thus displaced into the closed position not only by the bearing piece guided in the second guide curve, but also additionally by a part of the transmission element, when inserting the capture pin of the holding element secured on the front panel into the capture pin guide of the support or the catch recess of the closure. The part of the transmission element interacting with the outer contour of the closure is preferably the second bearing element. Very particularly preferably, the second bearing element comprises a protruding head having a circular cross section for sliding along the outer contour of the closure and pressing the same into the closed position.

Figure 2:
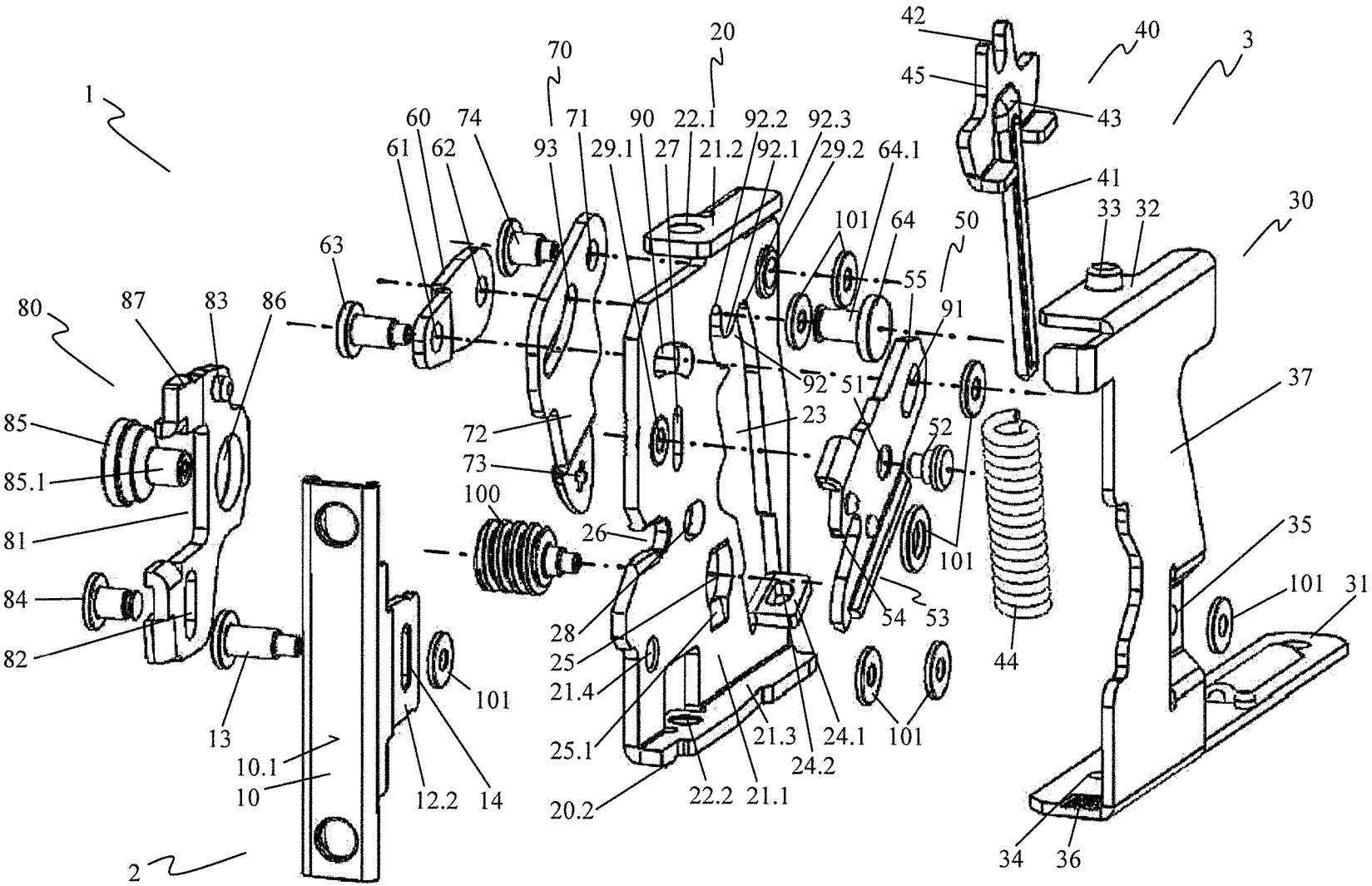
Figure 3:
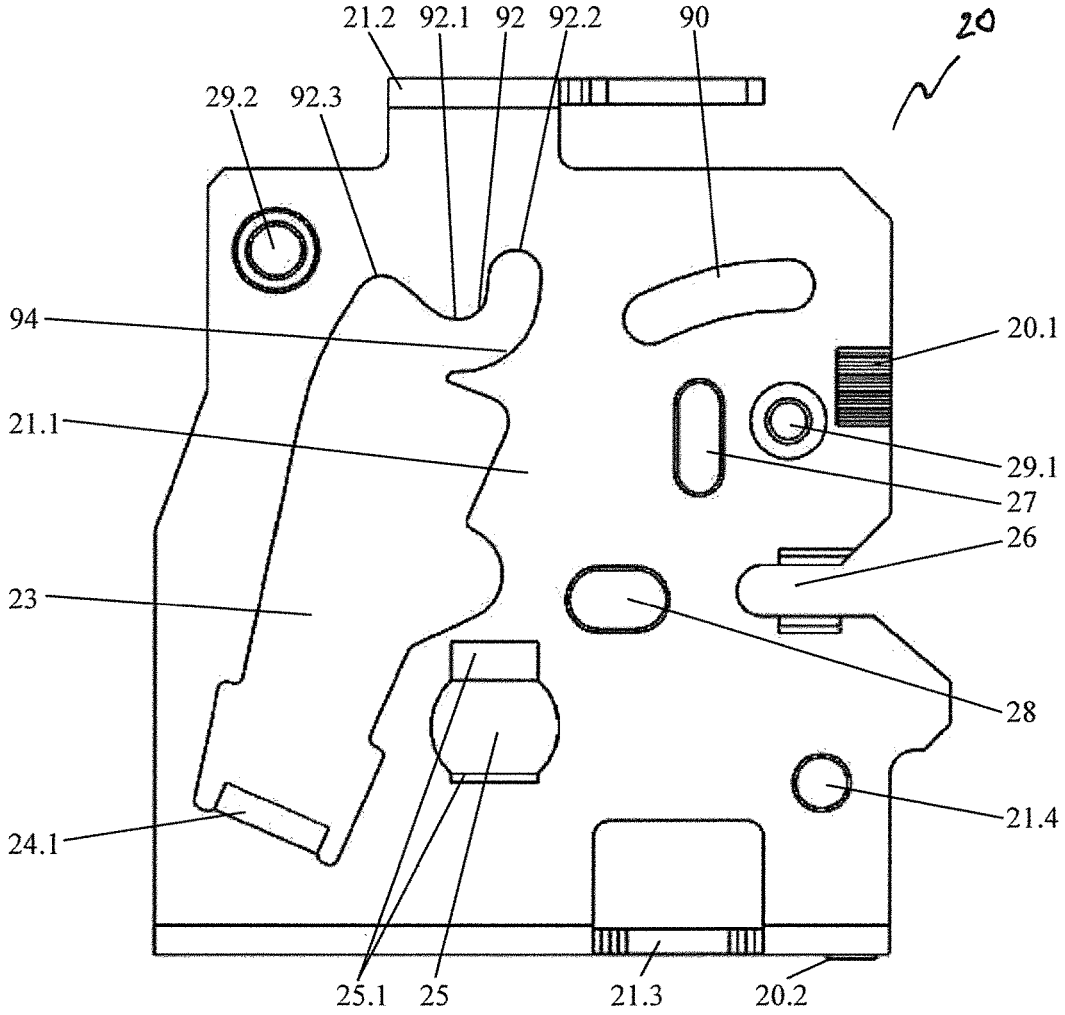
Figure 4:
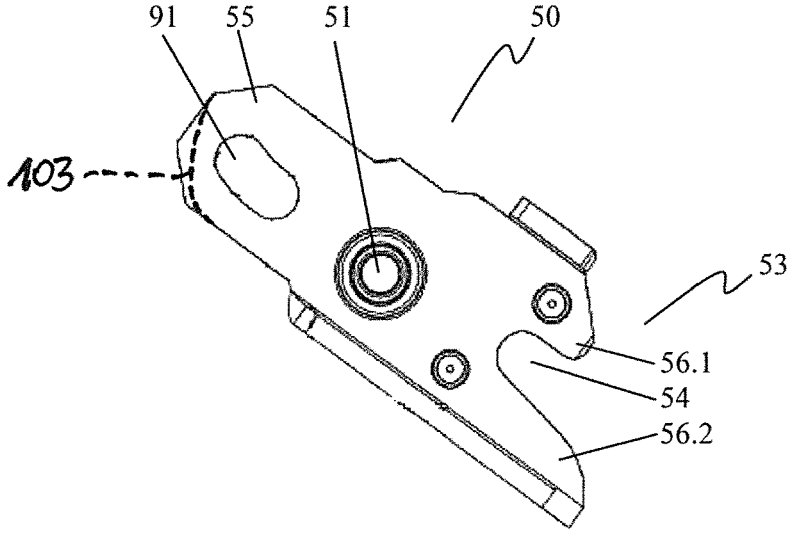
Figure 5:
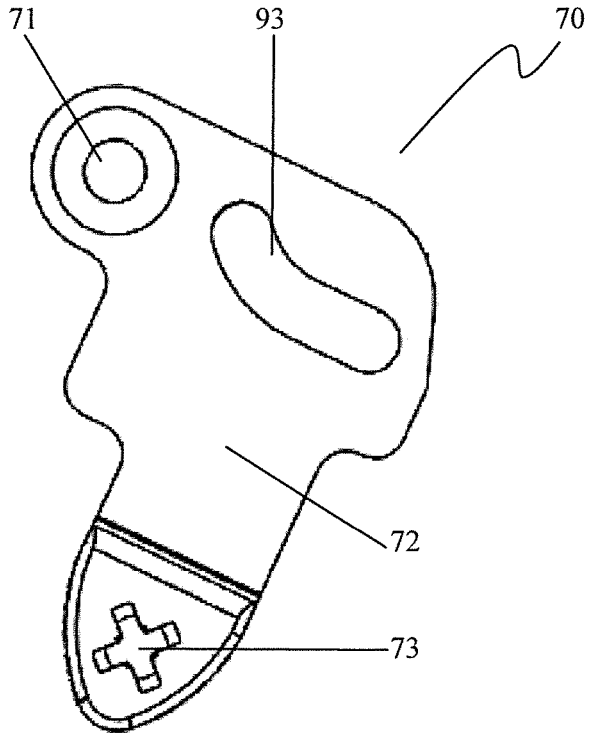
Figure 6:
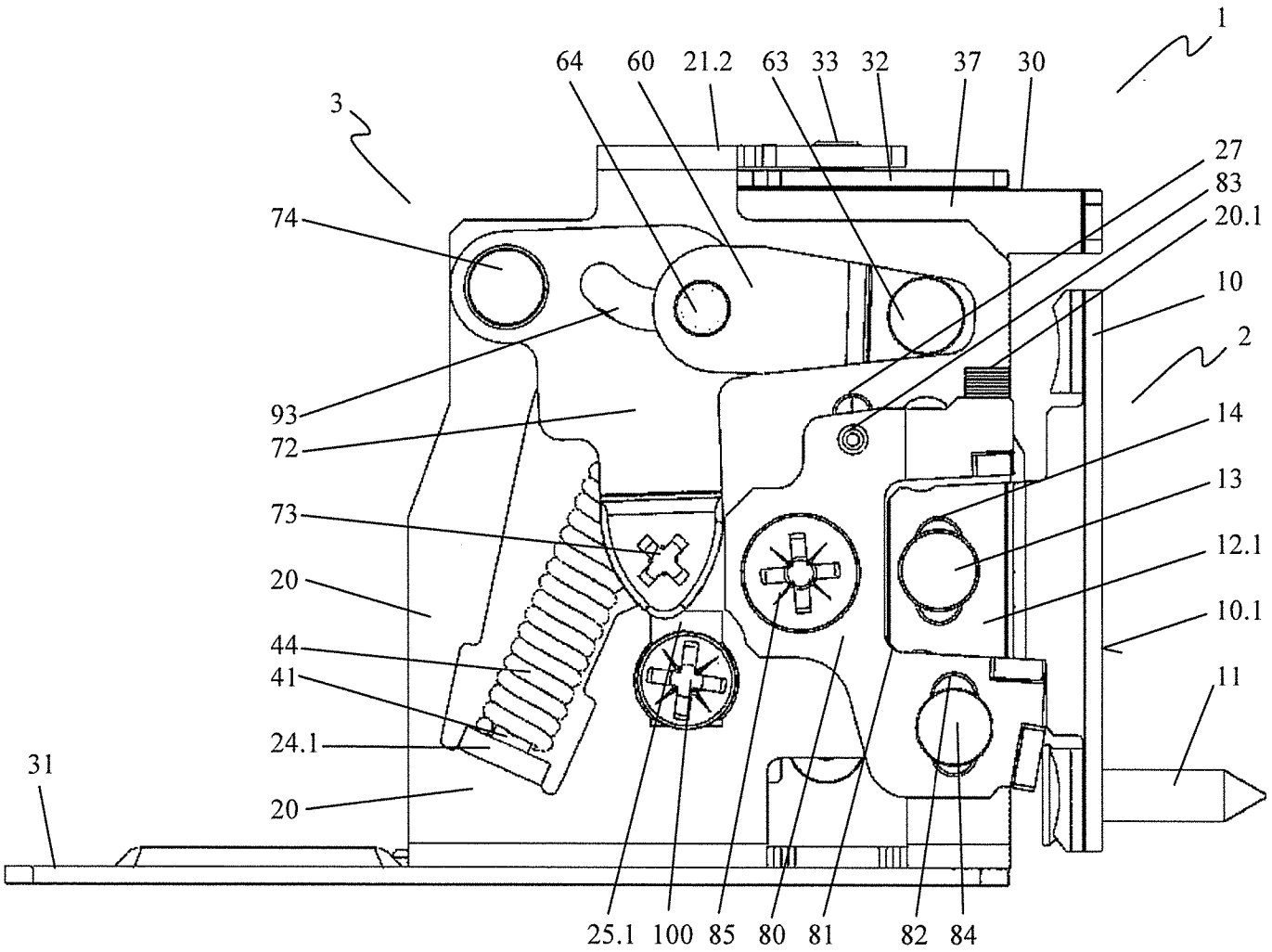
Figure 7:
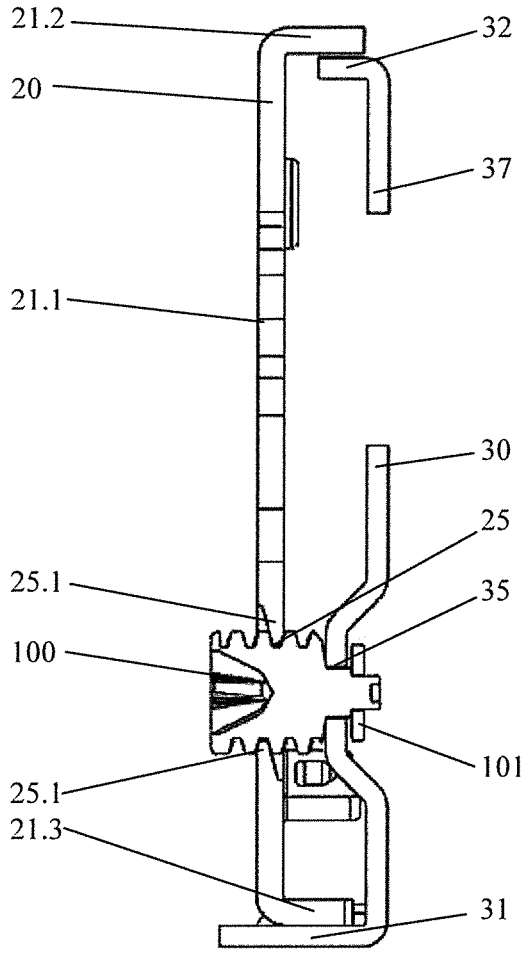
Figure 8:
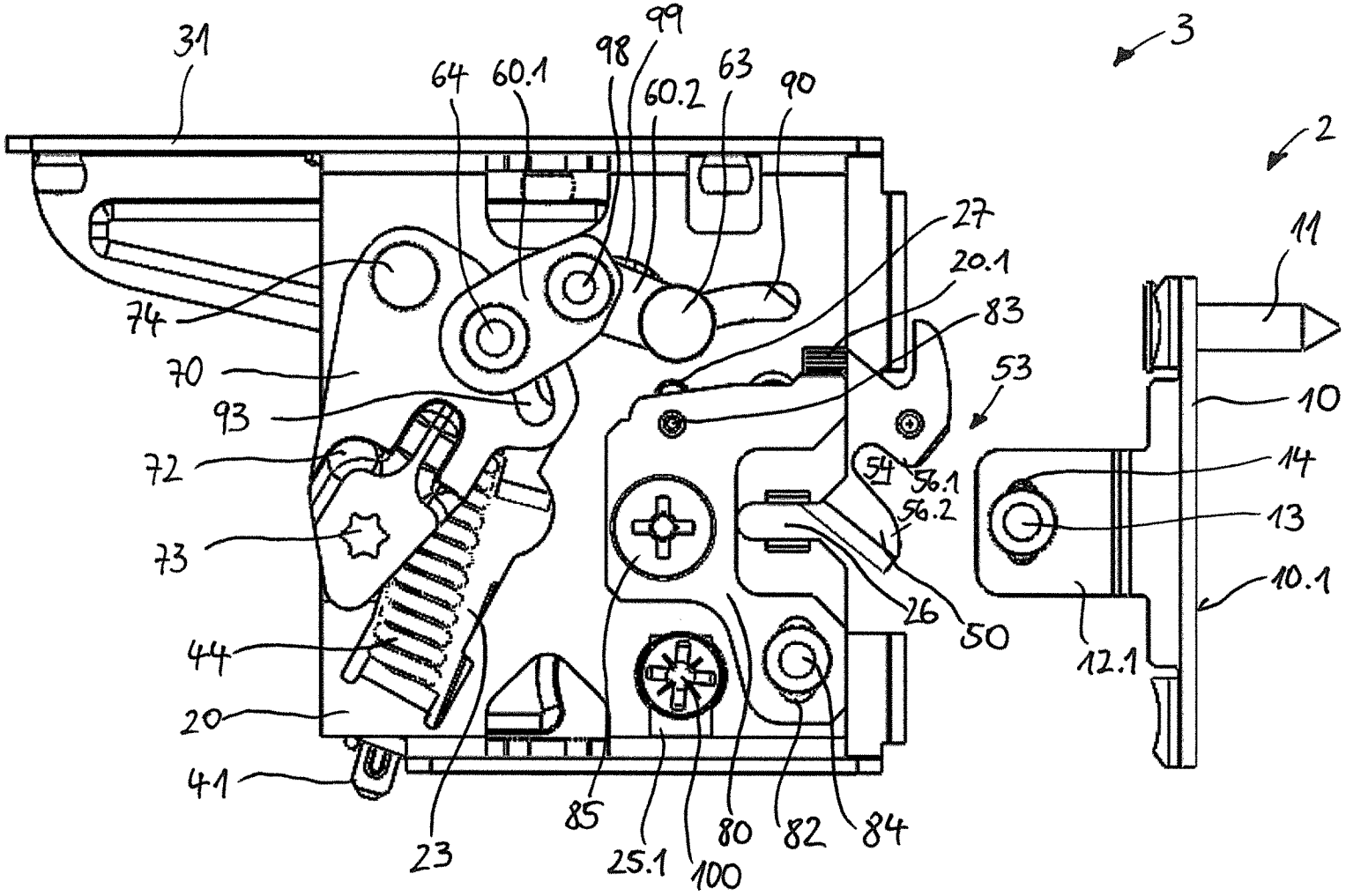
Figure 9:
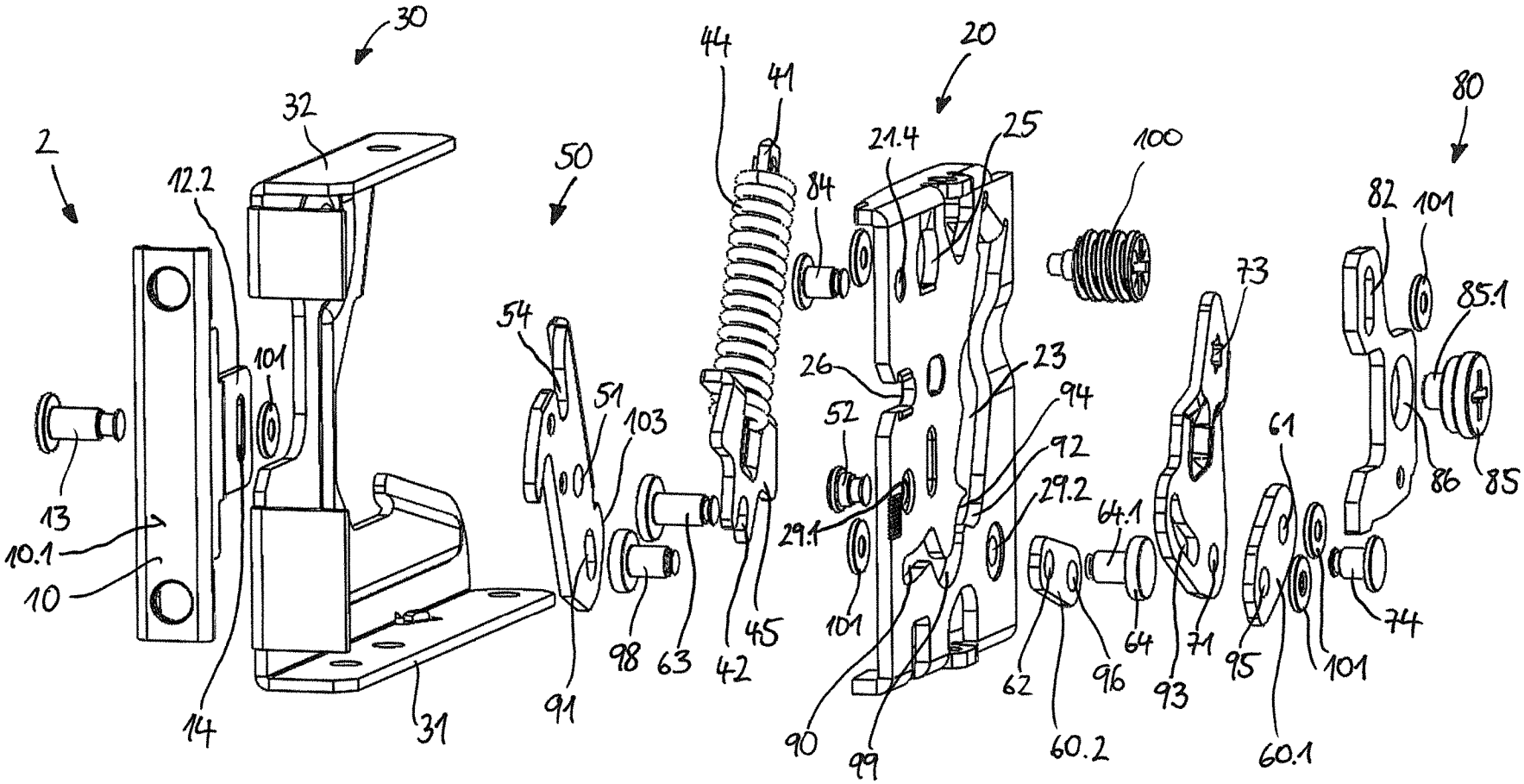
Figure 10:
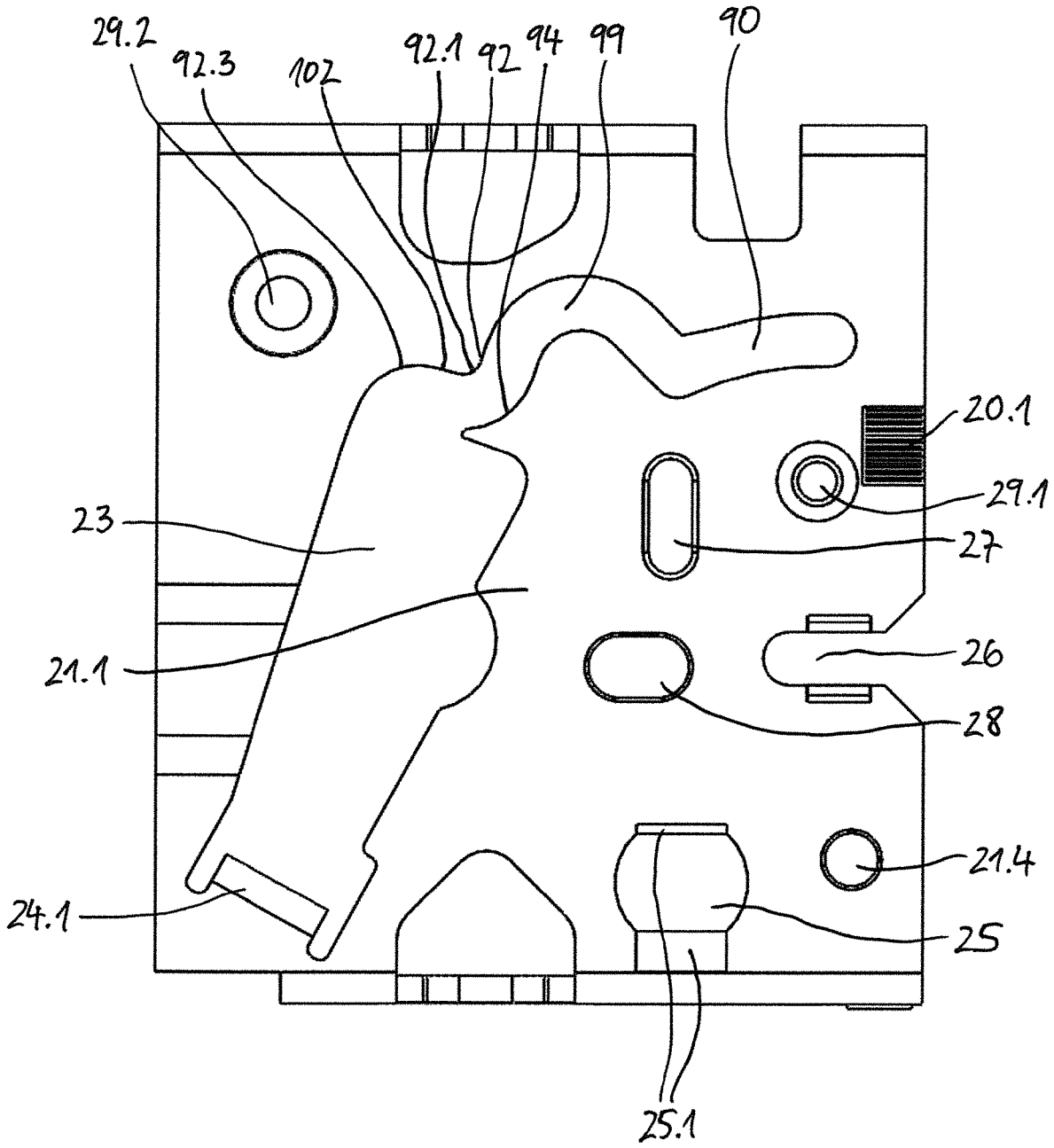
Figure 11:
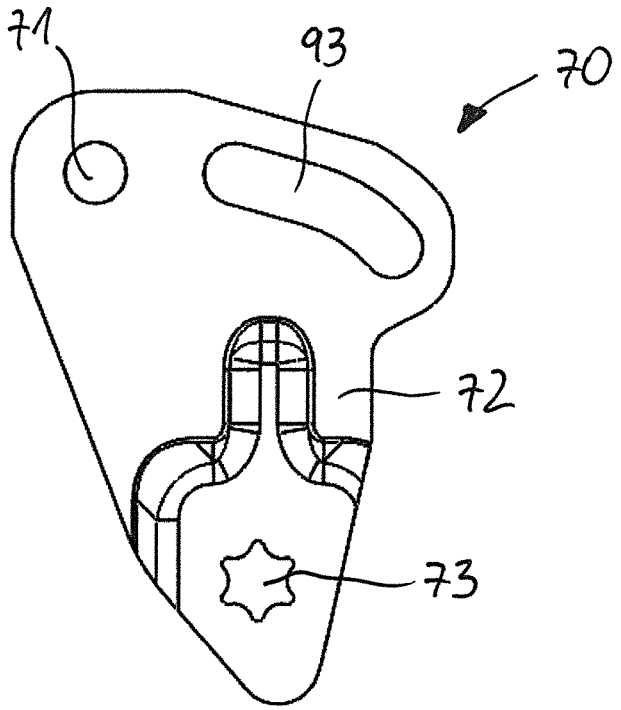
Figure 12:
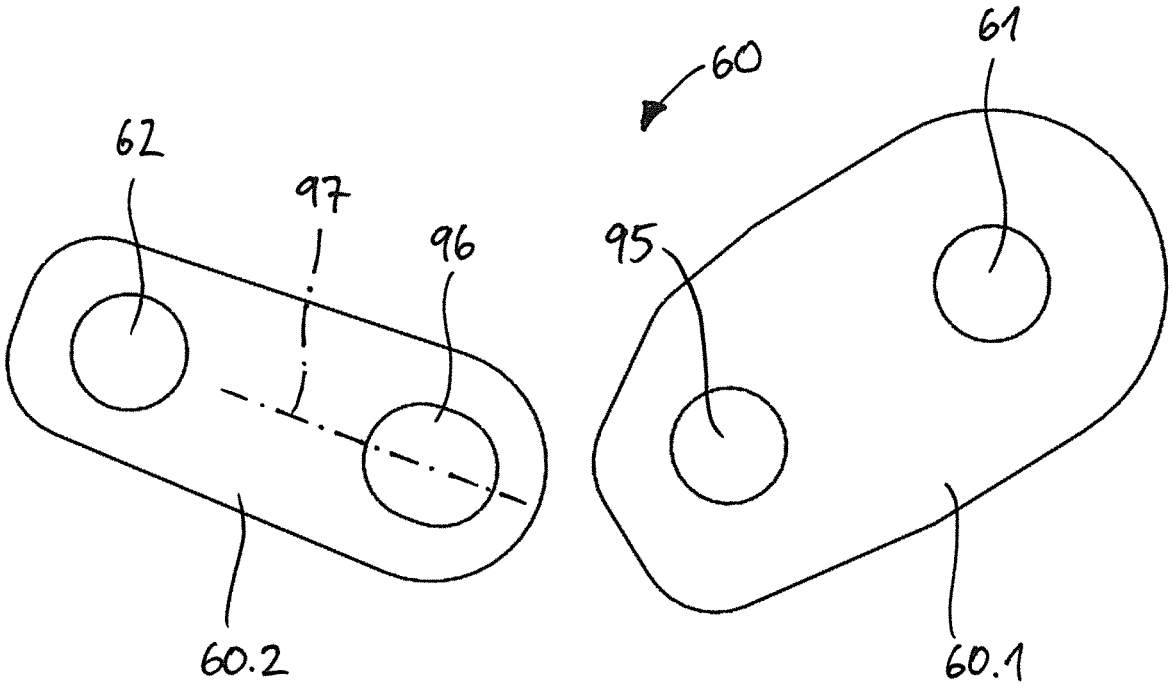
Figure 13:
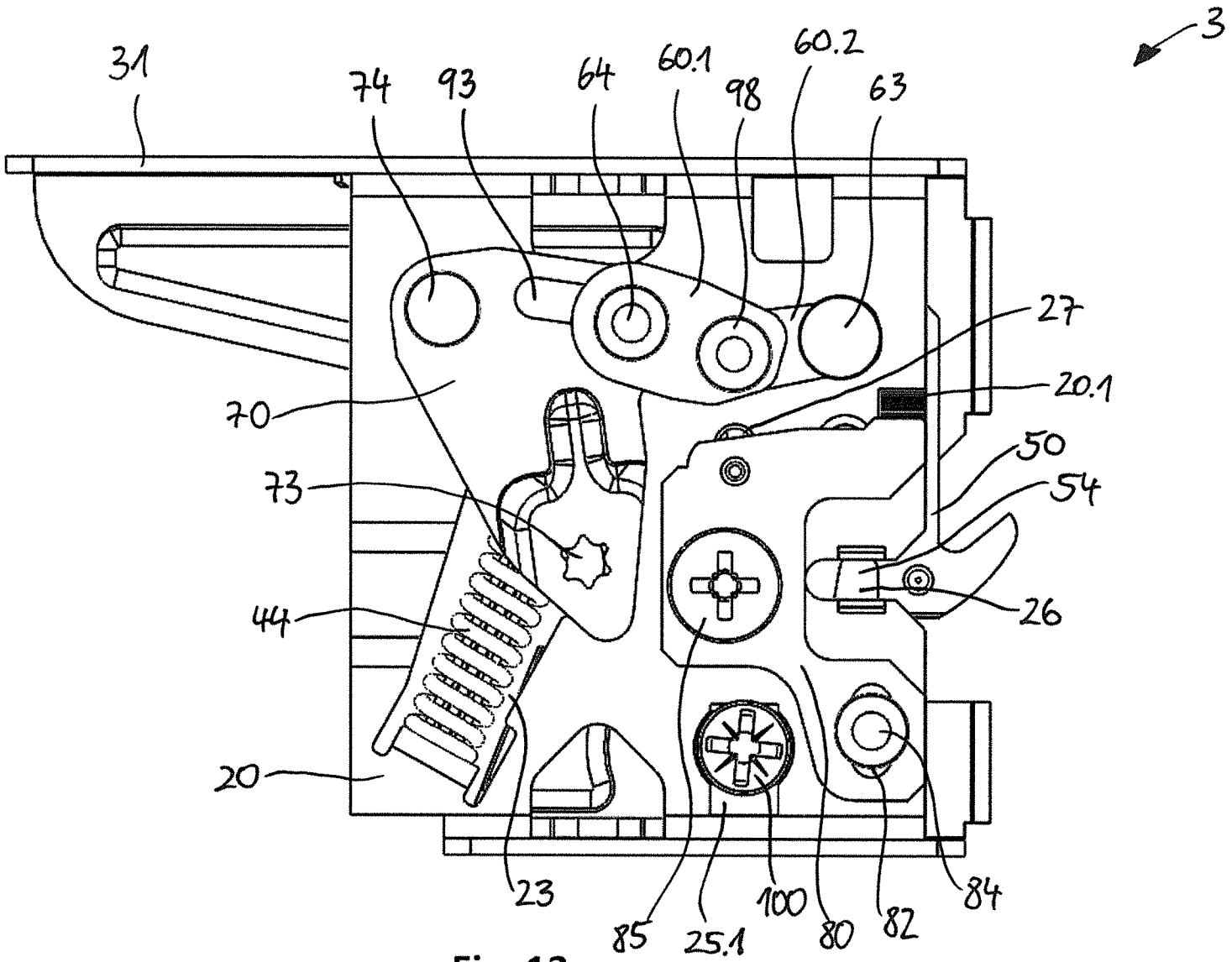

The invention is described in greater detail below using embodiment examples shown in the drawings. They show:

FIG. 1 A side view of a securing device for securing a front panel of a drawer on a drawer frame having a holding element and a closing element in an open position according to a first embodiment, FIG. 2 The securing device shown in FIG. 1 in an exploded view, FIG. 3 A side view of a support of the securing device from FIG. 1, FIG. 4 A side view of a closure of the securing device from FIG. 1, FIG. 5 A side view of an opener of the securing device from FIG. 1, FIG. 6 A side view of the securing device shown in FIG. 1 in a closed position, FIG. 7 A front view of the support and a receiving frame of the securing device from FIG. 1, FIG. 8 A side view of a securing device according to a different preferred embodiment example having a closing element in an open position, FIG. 9 The securing device from FIG. 8 in an exploded view, FIG. 10 A side view of a support of the securing device from FIG. 8, FIG. 11 A side view of an opener of the securing device from FIG. 8, FIG. 12 A side view of a multipart transmission element of the securing device from FIG. 8, FIG. 13 A side view of the securing device shown in FIG. 8 in a closed position.

A first preferred embodiment example of the present invention is explained using FIGS. 1 through 7. FIG. 1 shows a side view of a securing device 1 for securing a front panel of a drawer on a drawer frame having a holding element 2 and a closing element 3 in an open position.

The holding element 2 comprises a panel holder 10. The panel holder 10 forms a mounting surface 10.1 by means of which said holder can be placed against the inner side of the front panel, not shown. The panel holder 10 can then be secured to the front panel by means of securing elements 11. Two guide segments 12.1, 12.2 are formed on the panel holder 10 opposite the mounting surface 10.1 and spaced apart from each other. The guide segments 12.1, 12.2 are aligned at an angle, preferably 90°, to the mounting surface 10.1. It is also conceivable, however, to align the guide segments 12.1, 12.2 slightly inclined toward each other in order to allow easier inserting of the securing device 1. The second guide segment 12.2 shown in FIG. 2 is disposed covered by the first guide segment 12.1 in the selected view.

The guide segments 12.1, 12.2 are each penetrated by a capture pin receptacle 14. The capture pin receptacles 14 are implemented as elongated holes. Said holes are aligned in the plane of the mounting surface 10.1. A capture pin 13 is fixed in the capture pin receptacles 14. The position of the capture pin 13 can be adjusted along the capture pin receptacles 14. The panel holder 10 having the guide segments 12.1, 12.2 formed thereon is implemented as a stamped sheet metal part.

A support 20 is associated with the closing element 3. The support 20 is produced from sheet metal as a stamped part. Said support comprises a mounting region 21.1. A top contact area 21.2 at a top end and a bottom contact area 21.2 at a bottom end, relative to an installed situation on a drawer, not shown, are formed on the mounting region 21.1. The top contact area 21.2 and the bottom contact area 21.3 are aligned at an angle to the mounting region 21.1 toward a receiving frame 30 of the closing element 3. The receiving frame 30 is disposed nearly entirely covered by the support 20 in the selected view. Said frame is here also implemented as a stamped sheet metal part. The receiving frame 30 comprises a center segment 37 disposed spaced apart from the mounting region 21.1 of the support 20. A frame cover 32 is formed at the top end of the center segment 37 and a frame floor 31 is formed at the bottom end. The frame cover 32 and the frame floor 31 are thereby aligned at an angle to the center segment 37 and toward the support 20. The frame cover 32 thus contacts the top contact area 21.1 of the support 20 or is disposed spaced slightly apart from the same. The frame floor 31 contacts the bottom contact area 21.3 of the support 20 or is disposed spaced slightly apart from the same.

The frame cover 32 is pivotally connected to the top contact area 21.2 of the support 20 by means of a bearing stud 33. On the opposite end, the frame floor 31 is pivotally connected to the bottom contact area 21.3 by means of a rivet, not shown. The bearing stud 33 and the rivet, not shown, form a pivot axis about which the support 20 can be pivoted in a defined angle range relative to the receiving frame 30. It is also conceivable to provide a second rivet in place of the bearing stud 33. The pivoting connection between the support 20 and the receiving frame 30 is then produced by the two rivets. The pivot axis of the support 20 runs along the axis of the rivets aligned to each other in the present embodiment variant.

A capture pin guide 26 facing the holding element 2 is machined into the mounting region 21.1 of the support 20. The capture pin guide 26 is implemented as an elongated penetration starting from the edge of the mounting region 21.1 facing toward the holding element 2. The holding element 2 is aligned relative to the closing element 3 such that the capture pin 13 is disposed at the height of the capture pin guide 26. The holding element 2 can thus be pushed toward the closing element 3. The guide segments 12.1, 12.2 are thereby guided past the side of the mounting region 21.1. At the same time, the capture pin 13 is inserted into the capture pin guide 26 and guided therein. The capture pin guide 26 is expanded toward the opening thereof by formed bevels. When pushing the holding element 2 and the closing element 3 together, the capture pin 13 is thereby guided to the capture pin guide 26.

A height adjusting unit 80 is secured to the mounting region 21.1 of the support 20. The height adjusting unit 80 is implemented as a stamped sheet metal part. Said unit makes surface contact with the mounting region 21.1. The height adjusting unit 80 is substantially U-shaped in design. Said unit thus implements a receiving area 81 open in the direction toward the first guide segment 12.1 of the holding element 2. The contour of the receiving region 81 corresponds to the outer contour of the first guide segment 12.1. When pushing together the holding element 2 and the closing element 3, the first guide segment 12.1 is inserted into the receiving region 81 of the height adjusting unit 80 and guided thereby. The height adjusting unit 80 thus provides the precise alignment of the holding element 2 relative to the closing element 3. The height adjusting unit 80 is linearly adjustably connected to the mounting region 21.1. To this end, the height adjusting unit 80 comprises an elongated hole 82 at a first mounting point. A pin 84 is guided through the elongated hole 82 and fixed in a hole 21.4 in the mounting region 21.1 of the support 20 shown in FIG. 2. A guide stud 83 is formed on the height adjusting unit 80 at a second mounting point. The guide stud 83 is aligned in the direction of the guide stud receptacle 27 and guided in the same. The guide stud receptacle 27 is thereby implemented as an elongated hole in the mounting region 21.1 of the support 20, as can be seen in greater detail in the depiction in FIG. 2. The longitudinal extents of the elongated hole 82 and the guide stud receptacle 27 are aligned transverse to the direction of inserting of the first guide segment 12.1 of the panel holder 10. The relative position of the holding element 2 relative to the closing element 2 can thus be defined by correspondingly positioning the height adjusting unit 80 transverse to the direction of inserting the first guide segment 12.1 into the receiving region 81. The capture pin 13 can thereby be adjusted within the capture pin receptacles 14 such that the capture pin 13 is precisely aligned with the capture pin guide 26. The height adjusting unit 80 is linearly adjusted by actuating an eccentric pin 85 provided for this purpose. Height detent grooves 20.1 are worked into the support 20. A detent 87 is formed on the height adjusting unit 80 and engages in the height detent grooves 20.1. By actuating the eccentric pin 85, the height adjusting unit 80 can thus be adjusted in defined increments by means of the height detent grooves 20.1. Here a height adjustment of ±2 mm relative to the capture pin guide 26 is provided. The height detent grooves 20.1 are each spaced apart by 0.35 mm here. A resolution of the height adjustment of 0.35 mm is thereby defined.

A closure 50 is pivotally secured on the support 20. The closure 50 is produced as a stamped sheet metal part here. As can be seen in more detail particularly in FIG. 4, the closure 50 comprises a closure pin receptacle 51 implementing the center of rotation of the closure 50. The closure 50 is penetrated by a second guide curve 91 spaced radially apart from the closure pin receptacle 51. The second guide curve 91 is slightly curved in design. Said guide is substantially radially aligned. The second guide curve 91 is disposed in a coupling region 55 of the closure 50. A pawl 53 is formed on the closure 50 opposite the coupling region 55. The pawl 53 comprises an elongated pawl recess 54. Said recess is laterally bounded by pawl jaws 56.1, 56.2. A front pawl jaw 56.1 is thereby implemented shorter than a rear pawl jaw 56.2.

In the open position of the securing device 1, as shown in FIG. 1, the closure 50 is rotated such that the opening of the pawl recess 54 faces toward the capture pin 13 of the panel holder 10. The pawl recess 54 is thereby aligned at an angle to the direction of inserting the holding element 2. The shorter front pawl jaw 56.1 means that the capture pin 13 is guided past said jaw when inserting, so that said pin strikes the longer, rear pawl jaw 56.2. A corresponding force action when inserting the holding element 2 rotates the closure 50 about the axis of rotation thereof and guides the capture pin 13 into the capture pin guide 26. The capture pin 13 is retained in the closed position of the securing device 1, as shown in FIG. 6, by the capture pin guide 26 and the pawl recess 54 aligned transverse to said guide.

FIG. 3 shows a side view of the securing device 1. As described above, a top contact area 21.2 and a bottom contact area 21.3 are formed at an angle on the mounting region 21.1 of the support 20. The capture pin guide 26 is implemented as a penetration running in a straight line and open toward the edge of the mounting region 21.1 facing toward the holding element 2. The height detent grooves 20.1 are formed in the surface of the mounting region 21.1 as grooves running in the direction of the longitudinal extent of the capture pin guide 26.

A closure axis receptacle 29.1 is made as a hole in the mounting region 21.1 laterally offset from the capture pin guide 26. The closure axis receptacle 29.1 serves for pivotally securing the closure 50 on the support 20. A first guide curve 90 is disposed spaced apart from the closure axis receptacle 29.1. The first guide curve 90 is formed in the mounting region 21.1 as an elongated penetration. It runs in a curved path. The first guide curve 90 is thereby disposed circumferentially to the closure axis receptacle 29.1 over a limited angle range. The spacing of the first guide curve 90 from the axis of rotation of the closure 50 changes along the path of said curve. The axis of rotation of the closure 50 runs along the centerline of the closure axis receptacle 29.1.

The guide stud receptacle 27 is disposed laterally offset adjacent to the closure axis receptacle 29.1. An eccentric pin receptacle 28 is formed in the mounting region 21.1, also as an elongated hole. The eccentric pin receptacle 28 serves for receiving and guiding an eccentric lobe 85.1, as shown in FIG. 2, disposed eccentrically on the eccentric pin 85 shown in FIG. 1. The engaging of the eccentric lobe 85.1 in the eccentric receptacle 28 enables the height adjusting unit 80 to be adjusted by correspondingly actuating the eccentric pin 85. The mounting region 21.1 is further penetrated by the hole 21.4 in which the pin 84 shown in FIG. 1 is fixed for linearly adjusting the height adjusting unit 80 on the support 20.

A worm guide 25 in the form of a penetration is disposed in the mounting region 21.1. Embossments 25.1 are formed at opposite edges of the worm guide 25. As can be seen particularly in FIG. 7, the embossments 25.1 form tapering edge regions offset from each other corresponding to the pitch of a worm 100 threaded in. As further shown particularly in FIG. 7, the end of the worm 100 is connected to the receiving frame 30.

As shown in FIG. 3, the mounting region 21.1 is penetrated by a penetration 23 in the region of the support 20 facing away from the capture pin guide 26. The penetration 23 facing toward the top contact area 21.2 forms a first control curve 92. The first control curve 92 is disposed at approximately the height of the first guide curve 90. Said curve runs on a curved path. The curve thereby forms a vertex position 92.1 in the center region thereof and a first end position 92.2 and an opposite second end position 92.3 at the end regions thereof. The curvature of the first control curve 92 runs convex relative to the penetration 23. The two end positions 92.2, 92.3 are thus curved away from the penetration 23, while the vertex position 92.1 is guided into the penetration 23. A lead curve 94 is disposed in segments opposite the first control curve 92. A spring contact 24.1 is formed on the mounting region 21.2 at the end of the penetration 23 opposite the first control curve 92. The spring contact 24.1 is aligned at an angle to the mounting region 21.1. The angle between the mounting region 21.1 and the spring contact 24.1 is preferably at least approximately 90°.

A side lug 20.2 is formed on the bottom contact area 21.3. The side lug 20.2 is implemented as an elongated edge protruding past the bottom surface of the bottom contact area 21.3. When the securing device is assembled, the side lug 20.2 is thus aligned in the direction toward the frame floor 31 of the receiving frame 30 (see FIG. 1).

The mounting region 21.1 of the support 20 is further penetrated by an opener axis receptacle 29.2. The opener axis receptacle 29.2 serves for pivotally securing an opener 70. FIG. 5 shows a side view of the opener 70. Said opener is implemented here as a stamped sheet metal part. The opener 70 comprises an axis penetration 71. An opener holding pin 74 is guided through said axis penetration and through the opener axis receptacle 29.2 of the support aligned therewith (see FIG. 3), as can be seen particularly in FIGS. 1 and 6. The opener 70 is thus pivotally connected to the support 20. The opener 70 is thereby laterally guided along the mounting region 21.1 of the support 20. As can be seen in FIG. 5, the opener 70 comprises a second control curve 93. Said curve is formed by a penetration formed in the opener 70. The second control curve 93 is curved in design. The longitudinal extent thereof is thereby aligned substantially radially to the axis penetration 71 and thus to the axis of rotation of the opener 70. The opener comprises a lever segment 72. A tool receptacle 73 is formed in the end of the lever segment 72. The curvature of the second control curve 93 is such that the ends thereof are curved away from the tool receptacle 73.

As shown in FIG. 1, a transmission element 60 is associated with the closure element 3. The transmission element 60 is implemented here as a stamped sheet metal part. Said element has an elongated shape. As can be seen particularly in FIG. 2, one hole 61, 62 each is formed in the opposite end regions of the transmission element. As shown in FIG. 1, the transmission element 60 produces a mechanical connection between the opener 70 and the closure 50. To this end, a bearing piece 63 is held in the hole 61 on the closure side and a first bearing element 64 is held in the hole 62 on the opener side. The bearing piece 63 is guided by the first guide curve 90 on the support 20, starting from the transmission element 60, and the second guide curve 91 is guided on the closure. The first bearing element 64 is guided by the second control curve 93 on the opener, starting from the transmission element 60, to the first control curve 92 and the lead curve 94 on the support 20. The bearing piece 63 can thus be adjusted along the first guide curve 90 and the second guide curve 91. The first bearing element 64 can be adjusted along the first control curve 92 and the lead curve 94 and the second control curve 93.

As can be further seen in FIG. 1, a spring 44 is held on the spring contact 24.1. The spring 44 is implemented as a compression spring. Said spring is laterally guided by a spring mandrel 41 running inside the spring 44. The spring 44 has a spring force of about 120 N, wherein forces of up to 160 N can act in the securing device 1. The securing device 1 is implemented to be particularly stable and robust in order to be able to bear such high forces without damage.

FIG. 2 shows the securing device shown in FIG. 1 in an exploded view. The opener 70 is disposed to the side of the support 20. When assembling the securing device 1, the opener 70 is pivotally fixed in the opener axis receptacle 29.2 by means of the opener holding pin 74. One of the washers 101 shown is associated with the opener holding pin 74 to this end, to which the opener holding pin 74 is riveted at the end. The first bearing element 64 is guided through the penetration 23 and the second control curve 93 to the hole 62 of the transmission element 60 on the opener side and connected thereto. The first bearing element 64 is thus guided by the first control curve 92 and the lead curve 94 on the support 20 in segments, and by the second control curve 93 on the opener 70. The transmission element 60 is thus also guided by the first control curve 92, the lead curve 94, and the second control curve 93. The spring is associated with a spring holder 40. The spring holder 40 comprises a head region 45 on which a spring stop 43 is formed. The spring mandrel 41 is connected to the spring stop 43. Opposite the spring mandrel 41, a contact area 42 in the form of a U-shaped penetration open on one side is made in the head region 45. The contact area 42 is thereby open in the direction opposite the spring mandrel 41. For assembling, the spring 44 is placed onto the spring mandrel 41. The end of the spring mandrel 41 facing away from the head region 45 is then guided through a spring mandrel penetration 24.2 in the spring contact 24.1. The spring 44 is thus held between the spring stop 43 on the spring holder 40 and the spring contact 24.1 on the support 20. The contact area 42 of the spring holder 40 makes contact with the first bearing element 64. To this end, the contact area 42 encloses a segment of a cylindrical guide region 64.1 of the bearing element 64 also contacting the first control curve 92 and the second control curve 93. The spring 44 is implemented as a compression spring. Said spring thus transmits a force to the first bearing element 64 by means of the spring holder 40, whereby said element is pressed against the first control curve 92. The first bearing element 64 is thereby pressed into the first or the second end position 92.2, 92.3 of the first control curve 92, depending on which side of the vertex position 92.1 of the control curve 92 the first bearing element 64 is currently disposed. The transmission element 60 connected to the first bearing element 64 is thus displaced by the spring force into one or both stable end positions 92.2, 92.3 defined by the first control curve 92.

The closure is disposed aligned between the support 20 and the receiving frame 30 in the open position thereof. Said closure is pivotally connected to the support 20 by means of a closure holding pin 52. To this end, the closure holding pin 52 is guided through the closure pin receptacle 51 of the closure 50 and the closure axis receptacle 29.1 of the support in the assembled securing device 1 and axially fixed. The bearing piece 63 is guided through the hole 61 of the transmission element 60 on the closure side, the penetration on the support 20 forming the first guide curve 90, and the second guide curve 91 on the closure 50. The bearing piece 63 is held axially at the end by a connection to a washer 101.

The height adjusting unit 80 is spaced laterally apart from the support 20 and opposite the receiving frame 30. Said unit makes surface contact with the mounting region 21.1 of the support 20 for assembling the securing device 1, such that the guide stud 83 thereof is disposed in the guide stud receptacle 27 of the support 20. The pin 84 is guided through the elongated hole 82 of the height adjusting unit 80 and the hole 21.4 and fixed at the end to a washer 101. The eccentric pin 85 is guided through an eccentric guide 86 of the height adjusting unit 80 and an eccentrically disposed eccentric lobe 85.1 is guided in the eccentric receptacle 28 on the support 20. By actuating the eccentric pin 85, the height of the height adjusting unit 80 can be adjusted as described above.

The receiving frame 30 is aligned so that the frame cover 32 thereof and the frame floor 31 thereof face toward the support 20. When assembling the securing device 1, the frame cover 32 is pushed under the top contact area 21.2 of the support 20 such that the bearing stud 33 connected to the frame cover 32 is inserted into a bearing stud receptacle 22.1 formed in the contact area 21.2. The frame floor 31 of the receiving frame 30 encloses the bottom contact area 21.3 at the opposite end when assembling, such that a rivet passage 34 made in the frame floor 31 is disposed aligned to a rivet receptacle 22.2 penetrating the bottom contact area 21.3. The frame floor 31 and the bottom contact 21.2 are then connected to each other pivotally about the longitudinal axis of the rivet by means of a rivet, not shown. The bearing stud 33 and the rivet, not shown, thus form the pivot axis previously described, about which the support 20 can be pivoted in a defined angle range relative to the receiving frame 30. The bearing stud 33 is conical in design. The support 20 can thereby be positioned opposite the receiving frame 30 without clearance. Side detent grooves 36 are formed in the frame floor 31. When the securing device 1 is assembled, the side detent 20.2 of the support 20 engages in the side detent grooves 36. This allows the support 20 to be pivoted relative to the receiving frame 30 in detent steps defined by the side detent grooves 36. Here the side detent grooves 36 are selected such that the angle adjustment is possible at 1° increments.

From the perspective selected in FIG. 2, the second guide segment 12.2 can be seen and is formed on the panel holder 10 opposite the first guide segment 12.1 shown in FIG. 1. The two guide segments 12.1, 12.2 are disposed spaced apart from each other, so that when the holding element 2 and the closing element 3 are brought together, said segments enclose the support 20 and the closure 50 mounted thereon in the region of the capture pin guide 26 and the pawl jaw recess 54. The capture pin 13 is inserted through the capture pine receptacle 14 of the guide segments 12 disposed opposite each other and through a washer 101 at the end thereof for assembling the holding element 2. The capture pin 13 is thereby positioned within the capture pin guide 14 implemented as an elongated hole depending on the positioning of the height adjusting unit 80 on the support 20, such that the capture pin is aligned precisely opposite the capture pin guide 26 of the support 20. When connecting the holding element 2 to the closing element 3, the region of the capture pin 13 disposed between the two guide segments 12.1, 12.2 is inserted into the pawl jaw recess 54 and the capture pin guide 26.

FIG. 7 shows a front view of the support 20 and the receiving frame 30 of the securing device 1 in a partially assembled production state. The top contact area 21.2 of the support 20 contacts the frame cover 32 and the bottom contact area 21.3 thereof contacts the frame floor 31 of the receiving frame 30. As described above, the support 20 is pivotally supported relative to the receiving frame 30. The worm 100 is threaded into the worm guide 25 on the support 20. To this end, the thread of the worm 100 engages in the embossments 251 disposed opposite each other on the worm guide 25. The embossments 25.1 opposite each other are offset from each other corresponding to the pitch of the thread of the worm 100. The worm 100 can thus be threaded into the worm guide 25 at a right angle relative to the mounting region 21.1 of the support 20. The end of the worm 100 is supported in a worm bearing 35 implemented as a penetration in the receiving frame 30 and axially fixed by means of a washer 101. By rotating the worm 100, the support 20 can be pivoted relative to the receiving frame 30. In the application, this allows lateral adjusting of the front panel mounted on the drawer.

For securing a front panel to a drawer, the holding element 2 is first secured to the inner side of the front panel by means of corresponding securing elements 11, as shown as examples in FIG. 1. The frame floor 31 of the closing element 3 is secured to a frame of the drawer. The height adjusting unit 80 is adjusted by actuating the eccentric pin 85, such that the height of the front panel is aligned precisely relative to the drawer. To this end, the capture pin 13 is also positioned in the capture pin receptacle 14 so as to be precisely positioned relative to the capture pin guide 26. The front panel is aligned relative to the drawer in the lateral direction by means of the worm 100. Starting from the open position of the closure 50 shown in FIG. 1, the first guide segment 12.1 of the holding element 2 is inserted into the receiving region 81 of the height adjusting unit 80. The capture pine 13 is thereby pressed against the rear pawl jaw 56.2 of the closure 50. Said force acts to rotate the closure 50 about the axis of rotation thereof until the closed position of the securing device 1 shown in FIG. 6 is reached. In said closed position, the capture pin 13 is retained in the capture pin guide 26 and the pawl recess 54 aligned transverse to said guide. The pawl 53 having the pawl recess 54 thus forms a holding segment of the closure 50 and the capture pin 13 forms a holding region of the holding element 2 blocked or released by the holding segment depending on the position of the closure 50. The pivot motion of the closure 50 also displaces the bearing piece 63 coupled to the closure 50 in the second guide curve 91. The transmission element 60 connected to the bearing piece 63 is thereby also displaced. By displacing the transmission element 60, the first bearing element 64 is displaced along the first control curve 92, as shown in FIG. 3, from the second end position 92.3 into the first end position 92.2 when closing the closure 50. The spring force transmitted to the first bearing element 64 by the spring 44 thereby acts opposite the closing motion until the vertex position 92.1 of the first control curve 92 is passed. After passing the vertex position 92.1, the spring force transmitted to the first bearing element 64 acts in the direction of the first end position 92.2 and thus in the closing direction of the closure 50. The closure 50 is thus automatically displaced into the closed position thereof by the spring 44 in the last adjusting segment thereof. The capture pin 13 and thus the holding element 2 is thereby drawn into the closed position thereof shown in FIG. 6. When closing the closure 50, the opener 70 is also pivoted about the axis of rotation thereof by the first bearing element 64 guided in the second control curve 93.

In order to separate the front panel from the drawer again, a suitable tool, here a Phillips screwdriver, is inserted into the tool receptacle 73 of the opener 70. The opener is then rotated by means of the tool from the closed position thereof shown in FIG. 6 to the open position thereof shown in FIG. 1. The transmission element 60 is thereby displaced from the closed position thereof shown in FIG. 6 into the open position thereof shown in FIG. 1 due to the engaging of the first bearing element 64 in the second control curve 93. The force of the tool acts against the spring force. The first bearing element 64 is thereby not pressed against the first control curve 92 while the tool is used. The first bearing element 64 is now guided by the lead curve 94. Said lead curve is disposed spaced apart from the first control curve 92 and thus also intersects the second control curve 93. The spring force acting on the first bearing element first acts against the opening motion, until the first bearing element 64 has passed the vertex position 92.1 of the first control curve 92. After passing the vertex position 92.1 and after the tool is removed, the spring 44 presses the first bearing element 64 along the first control curve 92 in the direction of the second end position 92.3. The spring 44 thus supports the opening motion in the last adjusting segment thereof. The bearing piece 63 transmits the opening motion to the closure 50. Said closure is thus displaced from the closed position thereof shown in FIG. 6 into the open position thereof shown in FIG. 1. The pawl 53 of the closure 50 thereby releases the capture pin 13 and the holding element 2 can be removed with the front panel secured thereto.

The sequence of motion of the closure 50, the transmission element 60, and the opener 70 is defined by the two guide curves 90, 91 and the two control curves 92, 93. For the description below, the closing direction corresponds to the motion of each described component when closing the closure 50. Correspondingly, the opening direction of the motion corresponds to the motion of each component when opening the closure 50.

The guide curves 90, 91 together with the bearing piece 63 form a rotating/sliding connection between the transmission element 60 and the closure 50 on the closure side. The guide curves 90, 91 are aligned so as to intersect. The bearing piece 63 is disposed at the intersection point of the two guides 90, 91 at all positions of the closure 50. The first guide curve 90 is guided in an arc through an angle segment about the center of rotation of the closure 50. The distance between the first guide curve 90 and the center of rotation is thereby reduced in the closing direction. The bearing piece 63 is thus guided closer to the center of rotation of the closure 50 by the first guide curve 90 when closing the closure 50. In the closed position thereof, the longitudinal extent of the closure 50 is aligned between the top contact area 21.2 and the bottom contact area 21.3 of the support 20. The longitudinal extent of the closure 60 thus runs nearly parallel to the mounting surface 10.1 of the panel holder 10. The reduced distance between the bearing piece 63 and the center of rotation of the closure 50 means that the transmission element 60 is displaced only slightly or not at all in the direction toward the top contact area 21.2 during the closing motion. The overall height of the closing element 3 can thereby be kept low. The reduced distance between the rotating/sliding connection on the closure side and the center of rotation of the closure 50 means that at the end of the closing motion or the beginning of the opening motion, a large angular displacement of the closure 50 relative to the displacement of the transmission element 60 is achieved. The displacement path of the transmission element 60 required for closing and opening the closure 50 is thereby reduced. This enables a compact structure of the securing device 1. The substantially radial alignment of the second guide curve 91 on the closure 50 enables the radius to be changed at which the rotating/sliding connection on the closure side is guided about the center of rotation of the closure 50. The second guide curve 91 is thereby curved away from the transmission element 60 with an increasing radius relative to the center of rotation of the closure 50. When closing the closure 50, the rotating/sliding connection on the closure side is forced by the first guide curve 90 to a smaller radius from the axis of rotation of the closure 50. The second guide curve 91 is guided in the direction toward the transmission element 60 for said smaller radius. This causes an increased angular displacement of the closure 50 at the end of the closing motion thereof for a given displacement of the transmission element 60. Only a comparatively small displacement of the transmission element 60 is thus required in order to enable a comparatively large rotation of the closure 50. This leads to a further reduction in the required dimensions of the closing element 3. Guiding the rotating/sliding connection on the closure side along the intersecting guide curves 90, 91 makes it possible for a sufficiently large rotation of the closure 50 to release and fix the holding element 2 at a low installation height and reduced displacement paths.

The control curves 92, 93, together with the first bearing element 64, form a rotating/sliding connection on the opener side between the transmission element 60 and the opener 70. The control curves 92, 93 are aligned so as to intersect. The first bearing element 64 is disposed at the intersection point of the two control curves 92, 93 at all positions of the closure 50. The spring 44 exerts a force on the first bearing element 64. The first control curve 92 is has a curved path. The two end positions 92.2, 92.3 of the first control curve 92 are thereby curved in the direction of the force applied by the spring 44. A vertex position 92.1 disposed between the two end positions 92.2, 92.3 is curved opposite the direction of the applied spring force. The first control curve 92 is thus curved opposite the acting spring force. When the closure 50 is open, the spring 44 presses the first bearing element 64 into the second end position 92.3 of the first control curve 92. When the closure 50 is closed, the spring 44 presses the first bearing element 64 into the first end position 92.2 of the first control curve 92. The first control curve 92 thus defines two stable positions of the transmission element 60 and thus the closure 50. When the closure 50 is closed, as is shown in FIG. 6, pulling on the front panel, not shown, connected to the holding element 2 transmits a force to the closure 50. Said force acts in the opening direction of the closure 50, and is transmitted to the rotating/sliding connection on the opener side by means of the transmission element 60. The region of the first end position 92.2 of the first control curve 92 is aligned transverse to the force action transmitted to the rotating/sliding connection on the opener side by pulling on the front panel. The inclination of the first control curve 92 in the region of the first end position 92.2 thereof relative to the direction of the force action caused by pulling on the front panel is selected such that the first bearing element 64 is held in the first end position 92.2 in a self-blocking manner. Even strong pulling on the front panel can thus not unintentionally open the closure 50. By rotating the opener 70 in the opening direction about the axis of rotation thereof, a force is transmitted to the first bearing element 64 by means of the second control curve 93 acting in the direction of the alignment of the first control curve 92 in the region of the first end position 92.2 thereof. No self-blocking thus occurs for said force action. To rotate the opener 70, therefore, only the return force of the spring 44 must be overcome in order to displace the first bearing element 64 out of the first end position 92.2 to the vertex position 92.1 of the first control curve 92. After the vertex position 92.1, the spring 44 supports the opening motion and the first bearing element 64 is displaced into the second end position 92.3 of the first control curve 92.

For closing the securing device 1, starting from the open position of the closure 50 shown in FIG. 1, the capture pin 13 of the holding element 2 is pressed against the rear pawl jaw 56.2 of the pawl 53 of the closure 50. The closure 50 is thereby rotated in the closing direction. The rotary motion is transmitted to the transmission element 60 and by means thereof to the rotating/sliding connection on the opener side. For a sufficiently large closing force acting on the closure 50, the first bearing element 64 is displaced against the acting spring force from the second end position 92.3 of the first control curve 92 in the direction toward the first end position 92.2. After passing the vertex position 92.1, the spring force transmitted by the spring 44 supports the closing motion.

In order to enable the motion of the first bearing element 64 along the first control curve 92 when opening and when closing the closure, the second control curve 93 on the opener 70 is aligned substantially radially to the axis of rotation of the opener 70. The first bearing element 64 is disposed at a lesser radius along the second control curve 93 relative to the axis of rotation of the opener 70 when the closure 50 is open, and at a greater radius of the second control curve 93 when the closure is closed. The second control curve 93 is curved opposite the direction of rotation of the opener 70 in the region of least distance to the axis of rotation of the opener 70 when opening the closure 50. The curved path achieves a comparatively great displacing of the transmission element 60 and thus of the closure 50 for low displacing of the opener 70. Accordingly, only a small installation space must be provided in which the opener 70 must be displaced. This measure also leads to a compact structure of the securing device 1.

The described intersecting arrangement of the guide curves 90, 91 and control curves 92, 93 makes a great pivot angle of the closure 50 possible with a small space requirement and short positioning or rotating path of the opener 70. The design of the first control curve 92 thereby ensures self-blocking of the closure 50. The height adjustment and side adjustment can be used to precisely align an assembled front panel relative to a drawer.

A further preferred embodiment example of the present invention is explained using FIGS. 8 through 13. Identical components are thereby labeled with the same reference numerals as in the first embodiment example. The various elements and features of the various embodiment examples can be combined with each other in an arbitrary manner, even if not shown in the figures and not explicitly described.

One difference from the first embodiment example is that the transmission element 60 is multipart in design, particularly as a toggle lever having two lever arms 60.1, 60.2 connected to each other in an articulated manner in the embodiment example shown. The toggle lever 60 is shown in FIG. 12. The first lever arm 60.1 comprises the hole 61 at the end thereof on the closure side, in which the bearing piece 63 is held, and the second lever arm 60.2 comprises the hole 62 at the end thereof on the opener side, in which the first bearing element 64 is held. A further hole is implemented at the end of the first lever arm 60.1 facing away from the end on the closure side, and a receptacle 96 is implemented on the end of the second lever arm 60.2 facing away from the end on the opener side, also implemented as a hole or—as in the embodiment example shown—as an elongated hole. The elongated hole 96 has a longitudinal extent extending along a longitudinal axis 97 of the second lever arm 60.2. A second bearing element 98 (compare FIGS. 8, 9, and 13) is passed through the hole 95 and the elongated hole 96, so that the two lever arms 60.1, 60.2 are hinged in the manner of a toggle joint. The bearing element 98 thus forms a pivot point of the toggle lever 60.

The second bearing element 98 is guided by a third guide curve 99 on the support 20 (cf. FIG. 10) starting from the transmission element 60 and can slide back and forth therein when the securing device 1 is actuated. The third guide curve 99 can be implemented separately from the first control curve 92 and the first guide curve 90 in the support 20. In the embodiment example shown here, the third guide curve 99 is implemented in the support 20 in a transition from the first control curve 92 into the first guide curve 90, so that said three curves 90, 92, 99 together form a continuous curve path.

In an open position of the closure 50 (compare FIG. 8), the closure 50 is first held in the open position by the spring 44. The spring 44 thereby presses the first bearing element 64 against a stop 102 implemented between the vertex position 92.1 and the second end position 92.3 and comprising a planar extent running substantially perpendicular to a direction of action of the spring 44.

When inserting the capture pin 13 of the holding element 2 secured on the front panel of the drawer into the capture pin guide 26 of the support 20 and the pawl recess 54 of the closure 50, the closure 50 is displaced clockwise from the position shown in FIG. 8 about the closure holding pin 52 held in the closure pin receptacle 51. The motion of the closure 50 drives the transmission element 60, so that the first bearing element 64, the second bearing element 98, and the bearing piece 63 are displaced in each of the associated curves 92, 99, 90. As soon as the first bearing element 64 has left the stop 102 and passed the vertex position 92.1, the force of the spring 44 presses the transmission element 60 and the closure 50 coupled to the same by means of the bearing piece 63 and the second guide curve 91 in the direction of the closed position. This is particularly possible because the path of the curve 92 after passing the vertex position 92.1 comprises an extent running substantially parallel to a direction of action of the spring 44.

In the open position, the second bearing element 98 is disposed above an imaginary line connecting the first bearing element 64 and the bearing piece 63. When the securing device 1 transitions from an open position of the closure 50 into the closed position of the closure 50, the second bearing element 98 approaches ever closer to the imaginary connecting line and finally passes the same (compare FIG. 13). When the second bearing element 98 has passed the imaginary connecting line, self-blocking occurs and the closure 50 can no longer be opened by pulling in the direction of the open position. In the present embodiment example, self-blocking occurs even if the closure 50 is not yet completely in the closed position. Such a situation can occur, for example, if the closing element 3 is attached too far back on the drawer frame and the front panel has already made contact with the front of the drawer frame. In such a case, the capture pin 13 is not yet completely received in the pawl recess 54 of the closure 50. Nevertheless, the desired self-blocking occurs, so that the securing device 1 can no longer be released by pulling on the front panel and the front panel can no longer be unintentionally removed from the drawer frame. Due to the complex curve path of the curves 90, 92, 99, relatively large lever paths can be implemented along with compact dimensions of the securing device 1.

In the closed position, the first and second bearing element 64, 98 and the bearing piece 63—unlike in the first embodiment example—do not make contact with a stop. The first control curve 92, for example, does not have a first end position 92.2 for the first bearing element 64 in the closed position, because the first control curve 92 transitions into the third guide curve 99. The first guide curve 90 also does not form a stop at the end thereof for the bearing piece 63 in the closed position (compare FIG. 13). Such an embodiment even enables overclosing of the closure 50.

In order to reduce the clearance of the closure 50 in the closed position, and even completely eliminate clearance if possible, it can additionally be provided that part of the transmission element 60 presses the closure 50 into the closed position from the open position at least near the end of a motion of the closure 50. The corresponding part of the transmission element 60 preferably interacts with an outer contour 103 of the closure 50 (cf. FIG. 9 or FIG. 4, dashed line) and is supported on the outer contour 103 in the closed position at least near the end of the closing motion. Self-blocking results in this manner, by means of which the closure 50 is held in the closed position. The part of the transmission element 60 interacting with the closure 50 is preferably the second bearing element 98. It is particularly intended thereby that the second bearing element 98 comprises a head having a circular cross section able to make an operative connection with the outer contour 103 of the closure 50. The elongated hole implemented in the second lever arm 60.2 causes the head of the second bearing element 98 to be disposed at a distance from the outer contour 103 of the closure 50 in the open position (compare FIG. 8), while the head of the bearing element 98 contacts the outer contour 103 of the closure 50 in the closed position (or near the end of a motion into the closed position) and forces the same into the closed position and holds the same there (compare FIG. 13). The elongated hole 96 is also helpful for releasing the pretension or self-blocking when opening the closure 50. The elongated hole 96 also has the effect that no blocking or locking occurs during the motion of the first and second bearing elements 64, 98 and the bearing piece 64 in the curves 92, 99, 90, for example when passing particular vertex positions.

A further different of the present embodiment example in comparison with the first embodiment example is explained in greater detail using FIG. 11. The second control curve 93 is implemented in the opener 70 by a penetration. The second control curve 93 is curved in design. The longitudinal extent thereof is thereby aligned substantially radially to the axis penetration 71 and thus to the axis of rotation of the opener 70. The second control curve 93 intersects the first control curve 92. The curvature of the second control curve 93, however, is such that the ends thereof are curved toward the tool receptacle, in contrast to the first embodiment example. In this manner, greater lever paths can also be achieved along with compact dimensions of the securing device 1.

The invention claimed is:

1. A securing device for securing a front panel of a drawer to a drawer frame, the securing device comprising:

a holding element configured to be secured to the front panel, the holding element including a holding region; and a closing element configured to be secured to the drawer frame, the closing element including:

a support;

a closure including a holding segment, the closure being rotatably supported about an axis of rotation on the support, the closure being configured to expose the holding region of the holding element in an open rotational position of the closure, and to block the holding region in a closed rotational position of the closure;

a spring operatively connected to the closure; and a transmission element joined to the closure by a first rotating and sliding connection spaced from the axis of rotation of the closure;

an opener displaceably connected to the support; and a second rotating and sliding connection joining the opener to the transmission element, the second rotating and sliding connection including a first control curve and a second control curve intersecting the first control curve, and a first bearing element guided in the first and second control curves.

2. The securing device of claim 1, wherein:

the first control curve is disposed on the support; and the second control curve is disposed on the opener.

3. The securing device of claim 1, wherein:

at least one of the control curves runs on a curved path.

4. The securing device of claim 1, wherein:

the first bearing element is connected to the transmission element.

5. The securing device of claim 1, wherein:

the spring acts on the first bearing element transverse to an alignment of the first control curve; and the spring pushes or pulls the first bearing element into a first end position of the first control curve when the closure is closed and into an opposite second end position of the first control curve when the closure is opened.

6. The securing device of claim 1, wherein:

the first control curve is curved opposite an acting spring force of the spring.

7. The securing device of claim 1, wherein:

the spring pushes or pulls the bearing element into a first end position of the first control curve when the closure is closed and into an opposite second end position of the first control curve when the closure is opened; and the first bearing element can be displaced out of the first end position of the first control curve into the second end position of the first control curve by a rotary motion of the opener.

8. The securing device of claim 1, wherein:

the first bearing element is disposed along the second control curve at a greater radius relative to a center of rotation of the opener when the closure is closed, and at a lesser radius relative to the center of rotation of the opener when the closure is open.

9. The securing device of claim 1, wherein:

the second control curve is curved in an end region of the second control curve closest to a center of rotation of the opener, opposite to a direction of rotation of the opener when opening the closure.

10. The securing device of claim 1, wherein:

the spring pushes or pulls the bearing element into a first end position of the first control curve when the closure is closed and into an opposite second end position of the first control curve when the closure is opened;

a region of the first control curve including the first end position is aligned transverse to an acting force of the transmission element; and the bearing element is held in the first end position in a self-blocking manner when the closure is closed.

11. The securing device of claim 1, wherein:

the first rotating and sliding connection includes a first guide curve and a second guide curve intersecting the first guide curve.

12. The securing device of claim 11, wherein:

the transmission element includes at least two lever arms coupled to each other by a coupling joint, and the coupling joint includes a second bearing element received in a third guide curve.

13. The securing device of claim 12, wherein:

the transmission element comprises a toggle lever.

14. The securing device of claim 12, wherein:

the third guide curve is disposed on the support as a transition from the first control curve into the first guide curve, so that the first control curve, the third guide curve and the first guide curve form a continuous curve path.

15. The securing device of claim 12, wherein:

one of the lever arms is configured as a locking lever interacting with at least one of the third guide curve and the first guide curve, the locking lever being configured to secure the closure in the closed rotational position of the closure.

16. The securing device of claim 12, wherein:

the transmission element includes a part configured to force the closure into the closed rotational position of the closure by interacting with an outer contour of the closure at least near an end of a closing motion of the closure from the open rotational position of the closure into the closed rotational position of the closure.

17. The securing device of claim 16, wherein:

the part of the transmission element is the second bearing element.

* * * * *